US006675719B1

(12) United States Patent
Feider et al.

(10) Patent No.: US 6,675,719 B1
(45) Date of Patent: Jan. 13, 2004

(54) RAILROAD CAR WHEEL HANDLER AND METHOD

(75) Inventors: Thomas Feider, Sturgeon Bay, WI (US); John E. Braun, Sturgeon Bay, WI (US)

(73) Assignee: Marine Travelift, Inc., Sturgeon Bay, WI (US)

( * ) Notice: Subject to any disclaimer, the term of this patent is extended or adjusted under 35 U.S.C. 154(b) by 0 days.

(21) Appl. No.: 10/187,630

(22) Filed: Jul. 2, 2002

(51) Int. Cl.[7] ..... B61K 5/00

(52) U.S. Cl. ..... 104/32.1; 212/270; 212/344; 254/2 R; 254/33; 254/89 R

(58) Field of Search ..... 104/32.1, 262, 104/263, 272, 273; 254/2 R, 33, 89 R; 212/270, 344; 294/68.3; 414/459, 460

(56) References Cited

U.S. PATENT DOCUMENTS

| | | | | | |
|---|---|---|---|---|---|
| 1,283,656 | A | * | 11/1918 | Burke | 414/678 |
| 1,341,501 | A | * | 5/1920 | Earley et al. | 104/32.1 |
| 2,053,080 | A | | 9/1936 | Henricks | |
| 2,369,838 | A | | 2/1945 | Minnis | |
| 2,370,842 | A | * | 3/1945 | Christie | 104/32.1 |
| 2,451,042 | A | * | 10/1948 | Nancarrow et al. | 104/262 |
| 2,505,003 | A | * | 4/1950 | Perry et al. | 104/32.1 |
| 2,931,519 | A | | 4/1960 | Beach | |
| 2,958,508 | A | * | 11/1960 | Martinez | 254/89 R |
| 3,161,309 | A | * | 12/1964 | Baudhuin et al. | 414/459 |
| 3,176,853 | A | * | 4/1965 | Baudhuin et al. | 212/344 |
| 3,251,311 | A | * | 5/1966 | Saxonmeyer | 104/32.1 |
| 3,362,351 | A | | 1/1968 | Robertson | |
| 3,744,652 | A | * | 7/1973 | Rieschel | 414/459 |
| 4,068,823 | A | | 1/1978 | Belanger | |
| 4,295,427 | A | * | 10/1981 | Waterman et al. | 104/32.1 |
| 4,715,762 | A | * | 12/1987 | Lanigan et al. | 414/460 |
| 4,747,745 | A | * | 5/1988 | Pippen et al. | 414/460 |
| 4,805,875 | A | | 2/1989 | Jackson et al. | |
| 4,903,946 | A | | 2/1990 | Stark | |
| 5,133,531 | A | | 7/1992 | Grashoff et al. | |
| 5,529,452 | A | * | 6/1996 | Boyles et al. | 414/460 |
| 5,582,451 | A | * | 12/1996 | Baumann | 294/68.3 |
| 5,876,018 | A | | 3/1999 | Crisp et al. | |
| 6,158,602 | A | * | 12/2000 | Zakula et al. | 212/270 |

* cited by examiner

*Primary Examiner*—S. Joseph Morano
*Assistant Examiner*—Lars A. Olson
(74) *Attorney, Agent, or Firm*—Wallenstein Wagner & Rockey, Ltd.

(57) ABSTRACT

A railroad car wheel changer assembly (10), adapted to be mounted on a gantry crane (12), is provided. The railroad car wheel changer assembly (10) includes a base assembly (60), a beam member (62) and a grappler assembly (64). The base assembly (60) is adapted to be attached to the gantry crane(12). The beam member (62) is attached to the base assembly (60). The grappler assembly (64) is adapted to engage a railroad car wheel assembly (100) and is attached to a first end of the beam member (62). The beam member (62) is articulatable to move the wheel assembly (100).

25 Claims, 6 Drawing Sheets

RAILROAD CAR WHEEL HANDLER AND METHOD

TECHNICAL FIELD

The present invention relates to an apparatus for handling a wheel assembly of a railroad car and, more particularly, to a gantry crane that can both lift the railroad car and handle the wheel assembly such as when changing the wheel assembly.

BACKGROUND OF THE INVENTION

The wheel assemblies of railroad cars generally include an axle and two flanged wheels fitted thereon. Typically, two wheel assemblies are attached to an articulating wheel truck. The condition of the wheel assemblies of railroad cars deteriorates over time. Such deterioration may result from normal use or from an accident or other incident causing sudden damage. Therefore, wheel assemblies must periodically be replaced.

Such replacement requires both an ability to lift the railroad car itself and an ability to replace or exchange the wheel assemblies. Typically, each of these functions is performed by a different or separate piece of machinery. FIG. 1 schematically shows a prior method of changing a wheel assembly. As shown, a jack may be placed under the coupling between two cars, or a boom crane or other type of mobile crane is positioned along side of the railroad car for raising the car. Prior to lifting or hoisting, the wheel assembly to be replaced is disconnected from its wheel truck so it remains on the track. Either the entire car or just the end of the car having the wheel assembly to be replaced is lifted.

Once lifting of the railcar is accomplished, a forklift, for example, having an attachment adapted to handle wheel assemblies removes the worn or damaged wheel assembly. The forklift is also used to replace the wheel assembly with a new or replacement assembly. The mobile crane then lowers the car and the replacement wheel assembly is properly attached.

Prior art methods for handling railroad car wheel assemblies have proven to be inefficient and cumbersome. Thus, there remains a need for an apparatus that can improve the process of handling railroad car wheel assemblies.

The present invention is provided to solve these and other problems.

SUMMARY OF THE INVENTION

The present invention provides an apparatus and method for handling a wheel assembly of a railroad car such as when changing the wheel assembly of the car. In particular, the present invention provides a wheel handling assembly adapted to be attached to a gantry crane or other structure.

According to a first aspect of the invention a railroad car wheel changer assembly adapted to be mounted on a gantry crane is provided. The wheel changer assembly comprises a base assembly adapted to be attached to a gantry crane, a beam member attached to the base assembly and a grappler assembly, adapted to engage a railroad car wheel assembly. The grappler assembly is attached to a first end of the beam member and the beam member is articulatable to move the wheel assembly.

According to another aspect of the invention, the beam member comprises a telescoping boom assembly.

According to another aspect of the invention the telescoping boom assembly comprises a first boom section pivotally attached to the base assembly and a second boom section adapted to telescope within the first boom assembly wherein the grappler assembly is attached to the second boom section.

According to another aspect of the invention, the base assembly comprises an upper base portion attached to the gantry crane, a lower base portion and a slewing mechanism. The beam member is attached to the lower base portion and the slewing mechanism rotationally connects the lower base portion to the upper base portion for rotational movement of the lower base portion with respect to the upper base portion in a generally horizontal plane.

According to another aspect of the invention the changer assembly further comprises a cylinder pivotally attached to both the base assembly and the beam member for rotating the beam member generally vertically about the base assembly.

According to another aspect of the invention the cylinder is attached to a second end of the beam member.

According to another aspect of the invention, a method of changing a railroad car wheel assembly attached to a wheel truck of a railroad car is provided. The method comprises the steps of providing a gantry crane having a railroad car wheel changer assembly attached thereto; positioning the gantry crane to straddle the railroad car; positioning the changer assembly to be adjacent the wheel assembly to be changed; disconnecting the wheel assembly from the wheel truck; raising at least an end of the railroad car with the gantry crane an adequate distance to permit the wheel assembly to be moved underneath the truck; engaging the wheel assembly with the changer assembly; lifting the wheel assembly with the changer assembly; swinging the wheel assembly clear of the wheel truck; and disengaging the wheel assembly.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
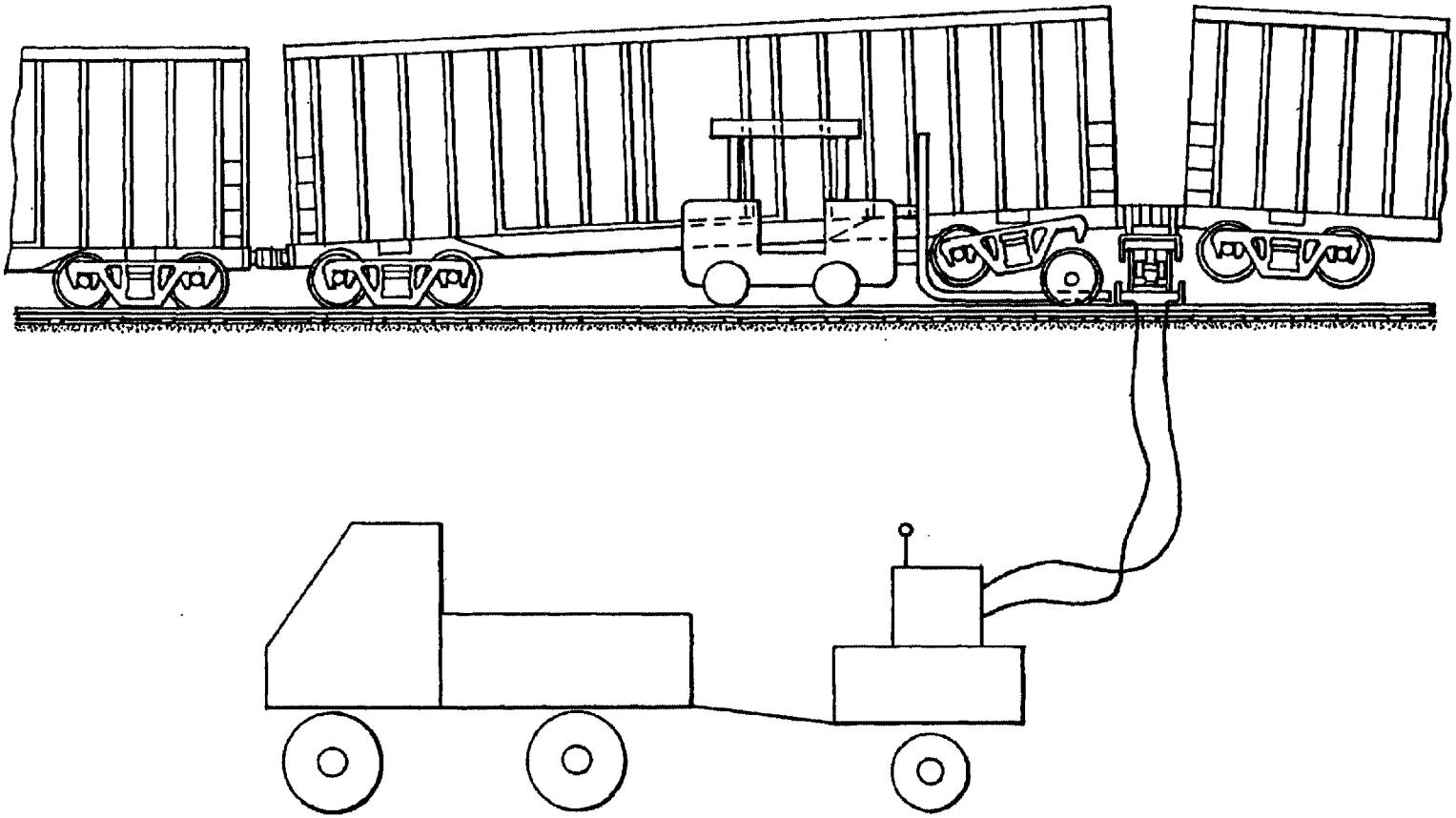
FIG. 1 (PRIOR ART)
FIG. 1 is a schematic view showing one prior art method of changing a wheel assembly of a railroad car.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
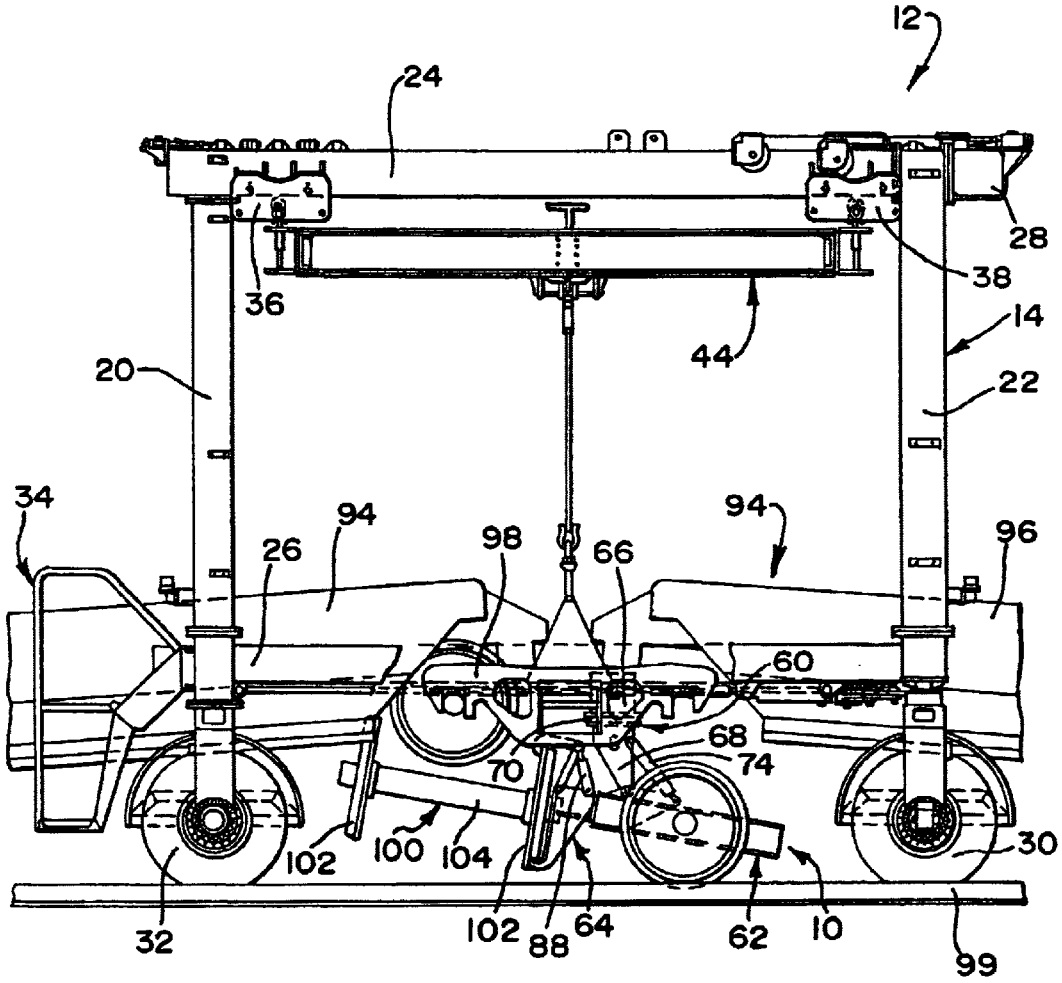
FIG. 2 is a side view of a gantry crane having a railroad car wheel handling assembly of the present invention.

FIG. 2 shows a railroad car wheel handling assembly 10 connected to a gantry crane 12. However, it is understood that the assembly 10 can be connected to other types of cranes or structures.

Figure 3:
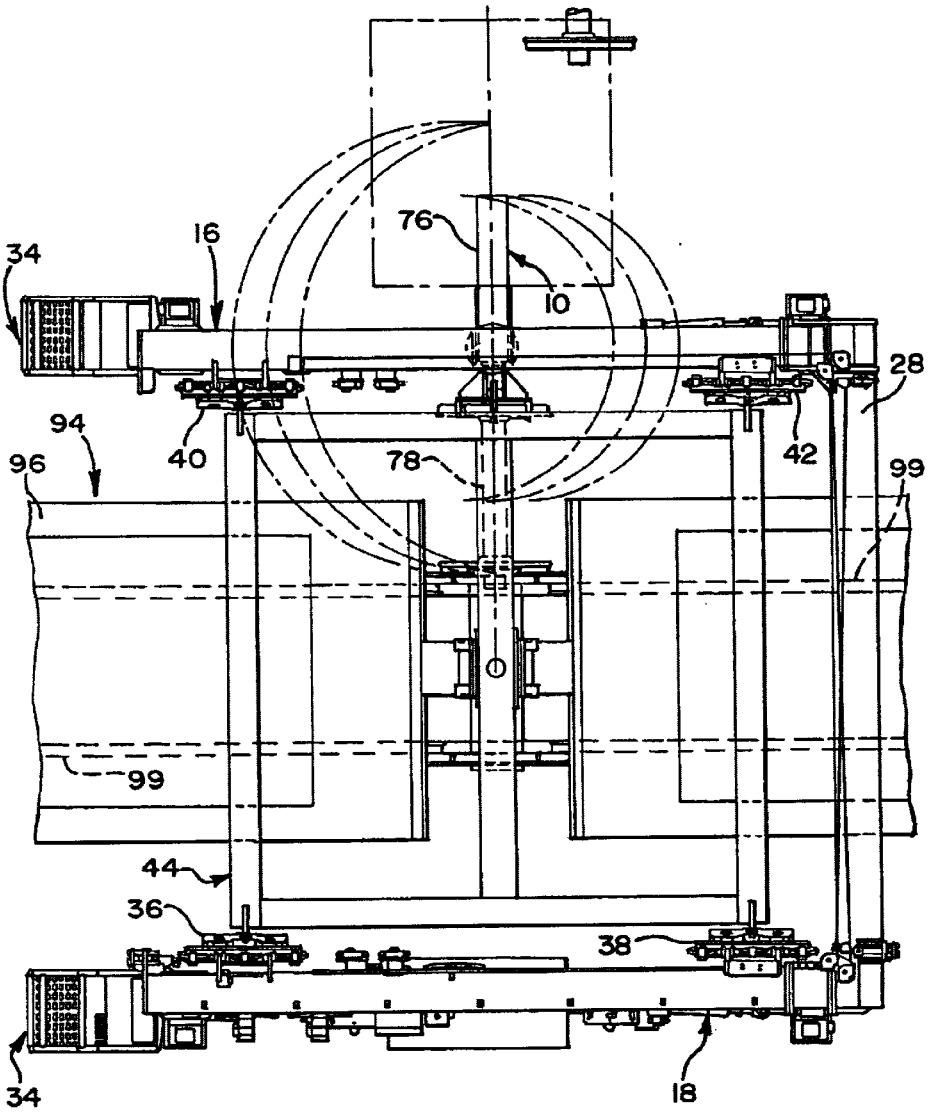
FIG. 3 is a top view of a gantry crane with the railroad car wheel handling assembly.

The gantry crane 12 generally includes a gantry structure 14 having a right side support frame 16 and a left side support frame 18 (FIG. 3). As the right side support frame 16 and the left side support frame 18 are substantially identical in all significant respects, only the left side support frame 18 is described in detail herein.

Referring to FIG. 2, the left side support frame 18 includes a left front vertical leg 20, a left rear vertical leg 22, a left upper side beam 24 and a left lower side beam 26. An upper cross beam 28 extends between and is connected to the right side support frame 16 and the left side support frame 18. A left front wheel 30 is located near a lower end of the left front vertical leg 20 and a left rear wheel 32 is located near a lower end of the left rear vertical leg 22. The right side support frame has a similar pair of wheels, not shown. Together the four wheels allow for a mobile gantry structure 14. An operator cab 34 is shown attached to the left side support frame 16. It is understood that the operator cab 34 can take other forms and be positioned at different locations. The operator cab 34 could also be mounted for movement between various locations.

A left front load block 36 and a left rear load block 38 are attached to the left side support frame 16. A right front load block 40 and a right rear load block 42 are similarly attached to the right side support frame 18. Attached to and suspended from the four load blocks is a spreader attachment 44. The load blocks 36–42 operate collectively to raise and lower the entire spreader attachment 44. The load blocks 36–42 and spreader attachment 44 function to lift a railroad car when changing a wheel assembly as explained in greater detail below.

Figure 4:
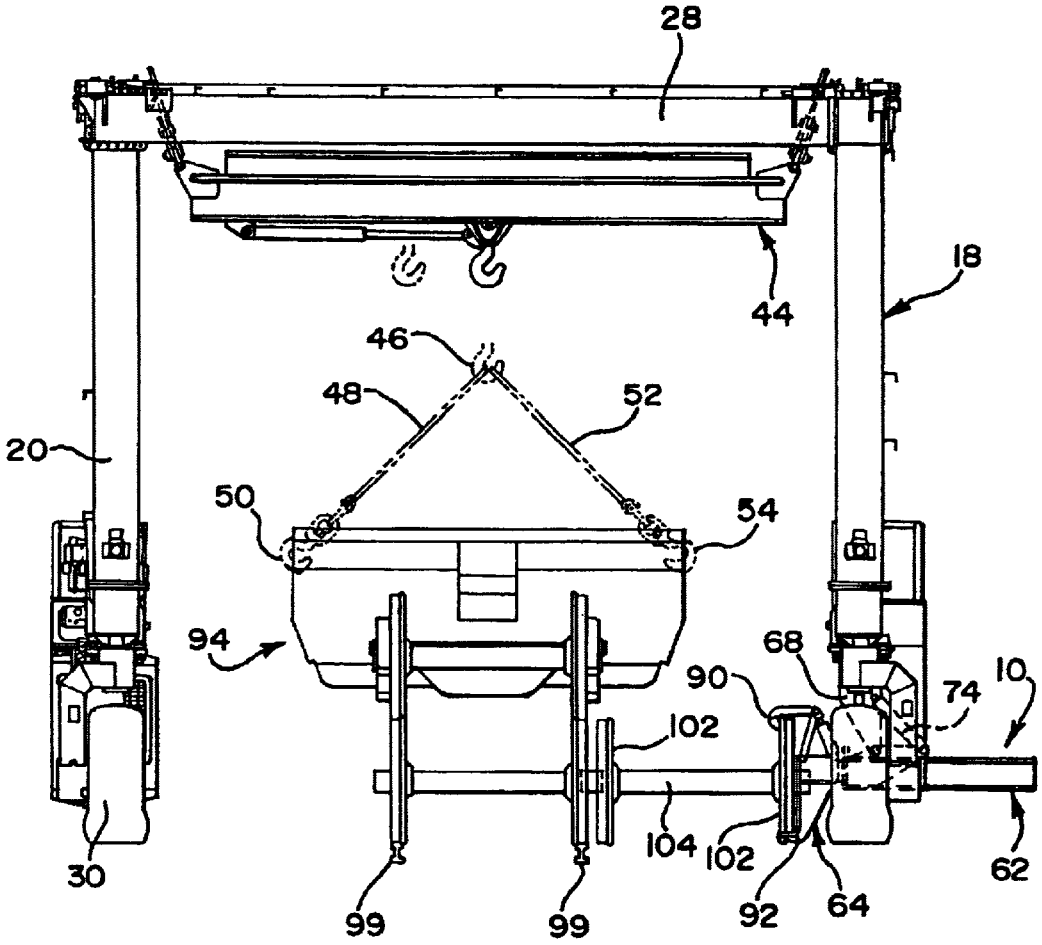
FIG. 4 is a rear view of a gantry crane with the railroad car wheel handling assembly.
Figure 5:
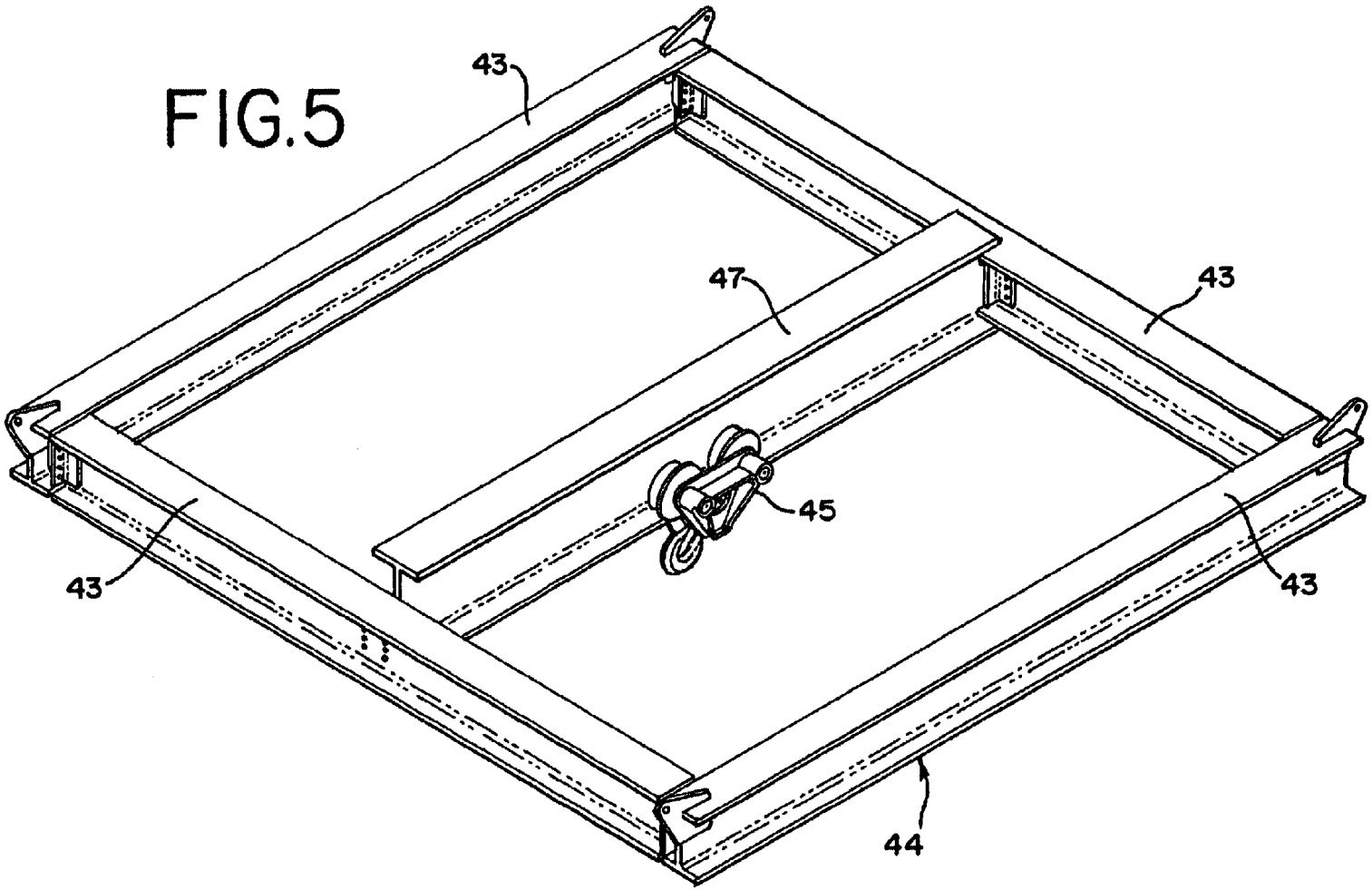
FIG. 5 is perspective view of a spreader attachment for the gantry crane.

As shown in FIGS. 2–5, the spreader attachment 44 has a plurality of interconnected beams 43 including a central beam 47. The beams 43 are connected to the load blocks 36–42. As shown in FIG. 5, a trolley 45 is mounted on the central beam 47. Attached to the trolley 45 is an eye hook 46. As shown in FIG. 4, depending from and attached to the eye hook 46 is a first sling 48 with a first sling hook 50 and a second sling 52 with a second sling hook 54. As further shown in FIG. 4, a hydraulic cylinder 49 is connected between the spreader attachment 44 and the trolley 45. The cylinder 49 and trolley 45 cooperate to permit lateral positioning of the eye hook 46 within the gantry structure 14 when aligning the eye hook 46 and sling hooks 50, 54 for lifting a railroad car.

As further shown in FIGS. 2–6, the wheel handling assembly 10 generally includes a base assembly 60, a beam member in the form of a telescoping boom assembly 62 and a grappler mechanism 64.

The base assembly 60 includes an upper base portion 66, a lower base portion 68 and a slewing mechanism 70. As shown (FIG. 6), the upper base portion 66 is slidingly mounted to a lower right side beam 27 via a connecting mechanism 80. The connecting mechanism 80 includes a pair of rail tracks 82, a double-ended hydraulic cylinder 84 and a proximity switch 86. The rail tracks 82 are welded or other wise connected to the underside of the lower side beam 27. The upper base portion 66 has a plurality of fingers 67 that fit around and ride along the rail tracks 82 as shown. Appropriate lubrication or slide bearings are included between the fingers 67 and the rail tracks 82 as needed. The proximity switch 86 is located near the center of the side beam 27 for detecting the longitudinal position of the base assembly 60 along the side beam 27. Each end of the double ended cylinder 84 is attached at an appropriate location on the side beam 27. The cylinder 84 is controlled via known hydraulic means. It is understood that other motive means may be employed to move the assembly 10 along the lower side beam 27.

The lower base portion 68 of the base assembly 60 is rotationally mounted to the upper base portion 66 by the slewing mechanism 70. Thus the slewing mechanism 70 operably connects the upper base portion 66 and the lower base portion 68. The slewing mechanism 70 controls and permits the slewing, or rotational movement of the lower base portion 68, and therefore the boom assembly 62, in a generally horizontal plane. One end of a first or luffing hydraulic cylinder 74 is attached to the lower base portion 68. Luffing refers to generally vertical rotation of the boom assembly 62 about the base assembly 60. Luffing results in the vertical raising and lowering of an end of the boom assembly 60, to be explained.

The beam member 62 or telescoping boom assembly 62 includes a first boom section 76 and a second boom section 78. The first boom section 76 is pivotally attached to both the lower base portion 68 and the luffing hydraulic cylinder 74. The first boom section 76 is tubular. The second boom section 78 is also tubular and is adapted to telescope within the first boom section 76. Not shown, but easily understood by those skilled in the art, is a hydraulic boom mechanism that effects the extension and retraction of the second boom section 78 with respect to the first boom section 76. It is further understood that additional boom sections can be employed, such as a third boom section telescoped within the second boom section 78.

It can be seen then, that the slewing mechanism 70, the luffing cylinder 74, and the hydraulic boom mechanism each provide separate means by which the beam member or telescoping boom assembly 62 may articulate with respect to the base assembly 60 and the upper base portion 66. Alternative means may be utilized to provide the desired movements of the boom assembly 62. For example, a universal ball joint and known hydraulic actuators may be provided between the upper base portion 66 and the lower base portion 68 to provide a means of articulation of the boom assembly 62.

The cross section of the first and second boom sections 76, 78 can be of any shape suitable for withstanding the stresses involved in handling railroad car wheel assemblies 100. Appropriate cross sections are known and can be determined by those skilled in the art. Additionally, the first and second boom sections 76, 78 are made of material suitable for withstanding the anticipated loads and stresses involved in handling railroad car wheel assemblies 100. In the particular embodiment described herein, the cross section of the first and second boom sections 76, 78 is generally rectangular and their material of construction is a suitable grade of steel.

As shown in FIGS. 2 & 4, the grappler mechanism 64 includes grippers 82 and a clamp cylinder 88. The grippers 82 include two lower stabilizing or positioning claws 92 and an upper locking claw 90. The clamp cylinder 88 is pivotally attached at one end to the grappler mechanism 64 and is pivotally attached at another end to the locking claw 90. The clamp cylinder 88 moves the locking claw 90 between locked and unlocked positions. The locked position is best shown in FIG. 4. When in the locked position the lock claw 90 cooperates with the stabilizing claws 92 to grasp, hold or engage the rail wheel assembly 100 as shown. When the upper locking claw 90 is raised from the locked to un-locked position, the locking claw 90 cooperates with the stabilizing claws 92 to release the rail wheel assembly 100.

Figure 6:
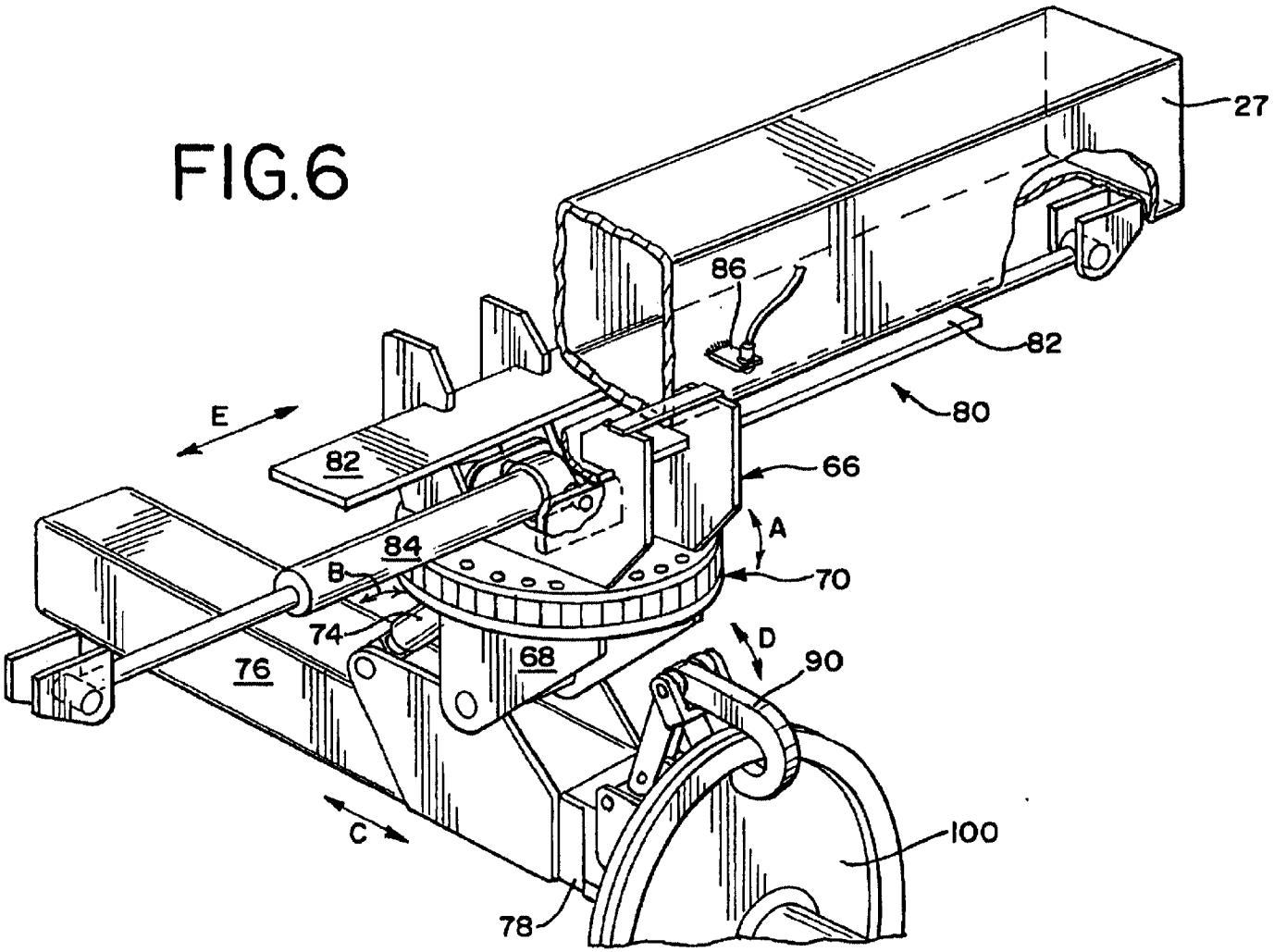
FIG. 6 is a partial perspective view of the wheel handling assembly connected to a lower side beam of the gantry crane, the assembly engaging a railroad wheel assembly.
Figure 6:
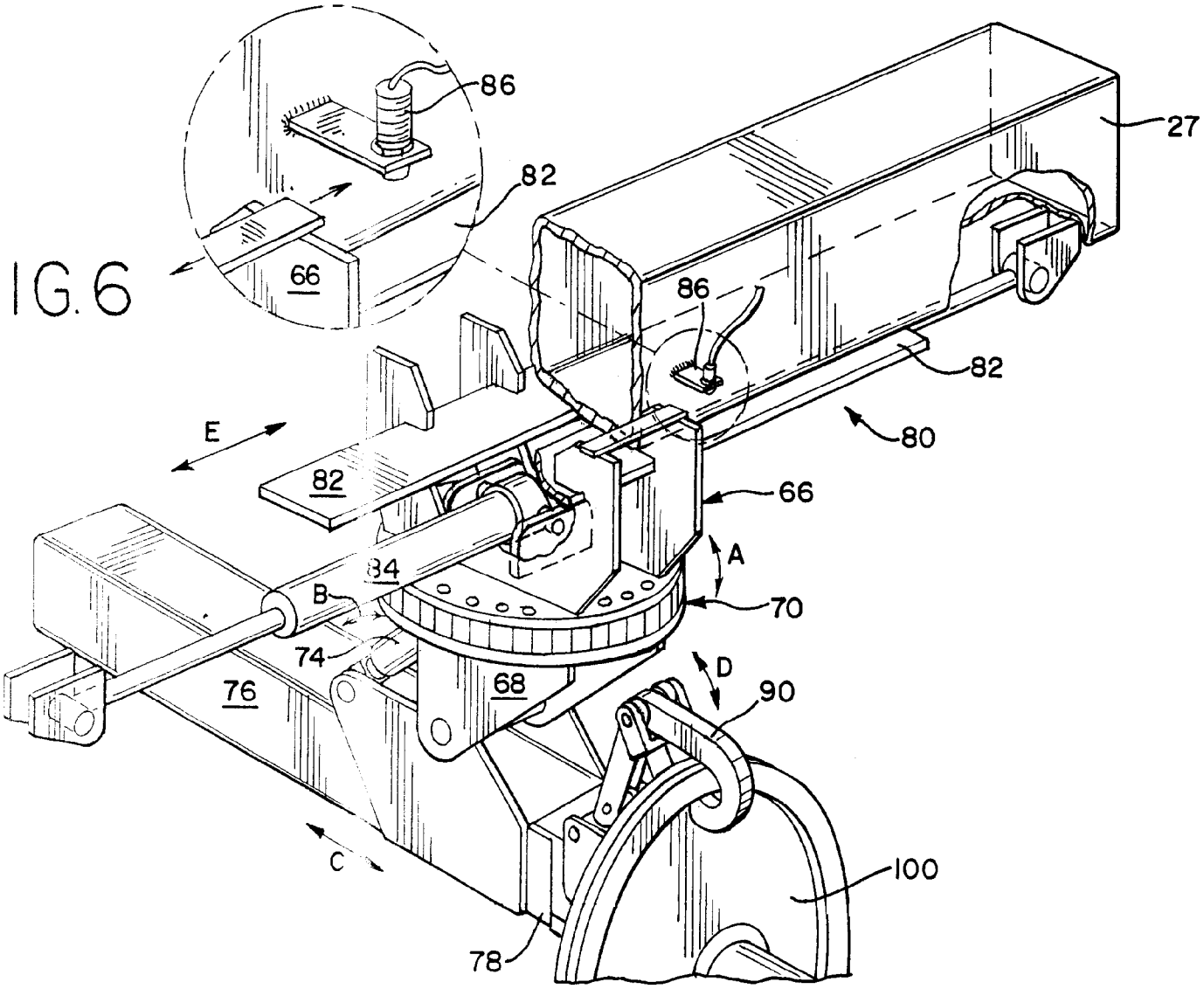

In operation and as shown in FIG. 6, the wheel handling assembly 10 is capable of five functions or directions of movement. First, the entire telescoping boom assembly 62 is capable of horizontal rotation about upper base portion 66 via the slewing mechanism 70 (See Arrow A). Second, the telescoping boom portion 66 is capable of vertical rotation or luffing with respect to the lower base portion 68 via the luffing hydraulic cylinder 74 (See Arrow B). Third, the grappler mechanism 64 is capable of linear movement towards and away from the base assembly 60 via the telescoping boom assembly 62 (See Arrow C). Fourth, the grippers 82 are capable of movement to effect locking onto or grasping of a railroad car wheel assembly (See Arrow D). Finally, the entire handling assembly 10 is capable of traversing the length of the lower right side beam 26 via the connecting mechanism 80. (See Arrow E.)

To change a railroad car wheel assembly 100, the gantry crane 12 with wheel handling assembly 10 is positioned to straddle a set of railroad tracks. Located on the tracks is the railroad car 94 having a wheel assembly 100 needing replacement (FIGS. 2–4). The railroad car 94 has a main body portion 96 supported by a wheel truck 98 and wheel assemblies 100 at each end. (Only one wheel truck 98 is shown in the figures for convenience.) Each wheel truck 98, in turn rides on the track rails 99 on a pair of wheel assemblies 100. Each wheel assembly includes a pair of flanged wheels 102 attached to an axle 104. FIGS. 3–5 show use of the wheel handling assembly 10 in conjunction with an intermodal railroad car 94, or one that is capable of accommodating containers. However, it is understood that the wheel handling assembly 10 can be used to change the wheel assemblies 100 of all types of railroad cars. The gantry structure 14 is of sufficient height to permit lifting of the railroad car 94.

The gantry crane 12 is then driven to the railroad car 94 and centered over the appropriate wheel truck 98. When the gantry crane 12 is properly positioned, the spreader 44 is lowered, thereby lowering the first sling hook 50 and second sling hook 54. The first and second sling hooks 50, 54 are attached to lifting lugs on the wheel truck 98 provided as a point for applying a lifting or hoisting force. At some point before attempting to raise the railroad car 94, the wheel assembly 100 is unattached from the wheel truck 98. Then the railroad car 94 with wheel truck 98 is raised by the load blocks 36–42 raising the spreader 44 which will raise the eye hook 46, first and second slings 48, 52 and first and second sling hooks 50, 54, thereby raising the railroad car 94. As the wheel assembly 100 was previously unattached from the railroad car, it remains on the rails. The wheel truck 98 is raised an adequate distance to allow the wheel assembly 100 to swing under the raised wheel truck 98 and railroad car 94.

As shown in FIG. 3, the wheel handler assembly 10 is rotated or slewed to bring the grappler mechanism 64 to the inside of the gantry crane 12. The handler assembly 10 is then trolleyed along the length of the lower side beam 26 via the connecting mechanism 80, to bring the boom assembly 62 and grappler mechanism generally 64 in line with and adjacent to the wheel assembly 100. That is, the double-ended hydraulic cylinder 84 is actuated to slide the assembly 10 along the length of the side beam 26 to the desired position.

From this general position, the wheel handler assembly 10 is manipulated to bring the lower stabilizing claws 92 into contact with the outside of the flange of the flanged wheel 102. The upper locking claw 90 is then positioned to hook over the top of the flanged wheel 102 by contacting the inside surface of the flange of the flanged wheel 102. This position can best be seen in FIGS. 4 and 6.

From this position, the wheel handling assembly 10 can lift the wheel assembly 100, primarily through luffing. The first boom section 76 is then retracted so the wheel assembly 100 fully clears the wheel truck 98. The handler 10 then traverses the lower side beam 26 until it is near the center of the lower side beam 27. This is necessary to ensure that the wheel assembly 100 will not strike either right wheel 30, 32 while it is being swung underneath the lower side beam 27. The proximity switch 86 detects the position of the upper base portion 66. The switch 86 will only allow the wheel handling assembly to swing the wheel assembly 100 under the side beam 27 if the upper base portion 66 is within a predetermined range of locations near the center of the side beam 27 thereby preventing the wheel assembly 100 from striking either wheel 30, 32. From this position, the wheel assembly 100 can be swung underneath the side beam 27 to the side and placed on the ground.

Once the old wheel assembly 100 has been set aside, the wheel handling assembly 10 is positioned near a new or replacement wheel assembly 100 located on the ground. The grappler mechanism 64 is positioned and manipulated as previously described to lock onto the new wheel assembly 100 which is then manipulated to be positioned on the track rails 99 underneath the raised wheel truck 98. When properly positioned, the upper locking claw 90 is unhooked from the wheel assembly 100, thereby releasing the same. The second boom section 78 is then fully retracted and the wheel handling assembly 10 is then swung out of the way. The load blocks 36–42 are operated to lower the spreader 44 ultimately lowering the railroad car 94 and wheel truck 98. The traversing trolley 45 of the spreader 44 may be used to position the wheel truck 98 laterally with respect to the rails 99 to facilitate proper positioning. The wheel truck 98 is set on the new wheel assembly 100. The proper attachments between the wheel assembly 100 and wheel truck 98 are then made completing the wheel assembly replacement.

Also, it is understood that the wheel handling assembly 10 can be adapted for attachment to structures in addition to gantry cranes. In additional embodiments, the wheel handling assembly 10 may be adapted for attachment to a stationary gantry crane, or other types of mobile or stationary cranes or lifting devices.

While the specific embodiments have been illustrated and described, numerous modifications come to mind without significantly departing from the spirit of the invention, and the scope of protection is only limited by the scope of the accompanying Claims.

We claim:

1. A railroad car wheel changer assembly adapted to be mounted on a gantry crane, the assembly comprising:

a base assembly adapted to be attached to a gantry crane:

a beam member attached to the base assembly; and a grappler assembly, adapted to engage a railroad car wheel assembly, attached to a first end of the beam member;

wherein the beam member is articulatable to move the wheel assembly.

2. The assembly of claim 1 wherein the beam member comprises a telescoping boom assembly.

3. The assembly of claim 2 wherein the telescoping boom assembly comprises:

a first boom section pivotally attached to the base assembly; and a second boom section adapted to telescope within the first boom assembly;

wherein the grappler assembly is attached to the second boom section.

4. The assembly of claim 2 wherein the telescoping boom assembly comprises:

a first boom section pivotally attached to the base assembly;

a second boom section adapted to telescope within the first boom assembly; and a third boom section adapted to telescope within the second boom assembly;

wherein the grappler assembly is attached to the second boom section.

5. The assembly of claim 1 wherein the base assembly comprises:

an upper base portion attached to the gantry crane;

a lower base portion; and a slewing mechanism;

wherein the beam member is attached to the lower base portion and the slewing mechanism rotationally connects the lower base portion to the upper base portion for rotational movement of the lower base portion with respect to the upper base portion in a generally horizontal plane.

6. The assembly of claim 5 wherein the upper base portion is slidingly attached to the gantry crane via a connecting mechanism comprising:

a track rail adapted to be attached to the gantry crane;

a double ended hydraulic cylinder adapted to be attached to the gantry crane and attached to the upper base portion, the cylinder capable of sliding the upper base portion along a length of the track rail; and a proximity switch adapted to be connected to the gantry crane for detecting the location of the upper base portion.

7. The assembly of claim 1 further comprising:

a cylinder pivotally attached to both the base assembly and the beam member for rotating the beam member generally vertically about the base assembly.

8. The assembly of claim 7 wherein the cylinder is attached to a second end of the beam member.

9. A railroad car wheel changer assembly adapted to be mounted on a gantry crane, the assembly comprising:

a base assembly adapted to be attached to a gantry crane:

a beam member attached to the base assembly;

a grappler assembly adapted to engage a railroad car wheel assembly, the grappler assembly being attached to a first end of the beam member; and means for articulating the beam member.

10. The assembly of claim 9 wherein the base assembly comprises an upper base portion attached to the gantry crane and a lower base portion;

wherein the means for articulating comprises a slewing mechanism for rotationally connecting the lower base portion to the upper base portion.

11. The assembly of claim 9 wherein the means for articulating comprises a cylinder pivotally attached to both the base assembly and the beam member for rotating the beam member in a generally vertical plane.

12. The assembly of claim 9 wherein the means for articulating comprises a telescoping boom assembly.

13. A railroad car wheel changer assembly adapted to be mounted on a gantry crane, the assembly comprising:

a base assembly adapted to be attached to the gantry crane;

a telescoping boom assembly pivotally attached to the base assembly; and a grappler assembly, adapted to engage a railroad car wheel assembly, attached to a first end of the boom assembly;

wherein the boom assembly is articulatable to move the wheel assembly.

14. The assembly of claim 13 wherein the boom assembly rotates in a generally vertical plane.

15. The assembly of claim 13 wherein the boom assembly rotates in a generally horizontal plane.

16. The assembly of claim 13 further comprising:

a cylinder pivotally attached to both the base assembly and to the boom assembly for rotating the boom assembly generally vertically about the base assembly.

17. The assembly of claim 16 wherein the cylinder is attached to a second end of the boom assembly.

18. The assembly of claim 13 wherein the base assembly is comprised of a rotating mechanism for rotating the boom assembly generally horizontally about the base assembly.

19. The assembly of claim 13 wherein the grappler assembly further comprises:

a plurality of grippers.

20. The assembly of claim 13 wherein the grappler assembly further comprises:

a locking clamp; and a plurality of stabilizing claws;

wherein the locking clamp and the stabilizing claws cooperate to engage the wheel assembly.

21. The assembly of claim 20 further comprising:

a clamp cylinder pivotally attached to the locking clamp for moving the locking clamp between latched and unlatched positions.

22. A railroad car wheel changer assembly adapted to be mounted on a gantry crane, the assembly comprising:

a base assembly adapted to be attached to the gantry crane, the base having an upper portion connected to a lower portion by a slewing mechanism, and the base assembly further having a first hydraulic cylinder;

a telescoping boom assembly pivotally attached to the lower portion and pivotally connected to the first hydraulic cylinder; and a grappler mechanism adapted to handle a railroad car wheel assembly, the mechanism being attached to the telescoping boom assembly and comprising a gripper and a second hydraulic cylinder pivotally attached to the telescoping boom assembly.

23. A gantry crane comprising:

a gantry structure; and a railroad car wheel changer comprising:

a base assembly adapted to be attached to the gantry structure, the base having an upper portion connected to a lower portion by a slewing mechanism, and the base assembly further having a first hydraulic cylinder;

a telescoping boom assembly pivotally attached to the lower portion and pivotally connected to the first hydraulic cylinder; and a grappler mechanism adapted to handle a railroad car wheel assembly, the mechanism being attached to the telescoping boom assembly and comprising a gripper and a second hydraulic cylinder pivotally attached to the telescoping boom assembly.

24. A method of changing a railroad car wheel assembly attached to a wheel truck of a railroad car, comprising the steps of:

providing a gantry crane having a railroad car wheel changer assembly attached thereto;

positioning the gantry crane to straddle the railroad car;

positioning the changer assembly to be adjacent the wheel assembly to be changed;

unfixing the wheel assembly from the wheel truck;

raising at least an end of the railroad car an adequate distance with the gantry crane to permit the wheel assembly to be moved underneath the truck;

engaging the wheel assembly with the changer assembly;

lifting the wheel assembly with the changer assembly;

swinging the wheel assembly clear of the wheel truck; and disengaging the wheel assembly.

25. The method of claim 24 further comprising the steps of:

engaging a replacement wheel assembly with the changer assembly;

swinging the replacement wheel assembly to a position underneath the wheel truck;

lowering the railroad car with the gantry crane;

affixing the replacement wheel assembly to the wheel truck; and disengaging the wheel assembly from the changer assembly.

* * * * *

UNITED STATES PATENT AND TRADEMARK OFFICE

CERTIFICATE OF CORRECTION

PATENT NO. : 6,675,719 B1
DATED : January 13, 2004
INVENTOR(S) : Thomas Feider and John E. Braun It is certified that error appears in the above-identified patent and that said Letters Patent is hereby corrected as shown below:

Drawings,
Replace Sheet 6, consisting of FIG. 6 with the attached formal drawing.

Column 6,
Line 57, the colon after "crane" should be a semicolon.

Signed and Sealed this

Twenty-first Day of March, 2006

JON W. DUDAS
*Director of the United States Patent and Trademark Office*